US005301237A

United States Patent [19]

Fosgate

[11] Patent Number: 5,301,237

[45] Date of Patent: Apr. 5, 1994

[54] SURROUND SOUND LOUDSPEAKERS

[76] Inventor: James W. Fosgate, 4750 E. 1200 South, Heber City, Utah 84032

[21] Appl. No.: 983,687

[22] Filed: Dec. 1, 1992

Related U.S. Application Data

[62] Division of Ser. No. 789,530, Nov. 14, 1991, Pat. No. 5,199,075.

[51] Int. Cl.[5] ..... H04R 1/02

[52] U.S. Cl. ..... 381/89; 381/97

[58] Field of Search ..... 381/17, 63, 88, 89, 381/90, 97, 24

[56] References Cited

U.S. PATENT DOCUMENTS

| | | | |
|---|---|---|---|
| 3,637,938 | 1/1972 | Kuhlow et al. | 381/24 |
| 3,710,023 | 1/1973 | Greuzard, Sr. et al. . | |
| 3,959,590 | 5/1976 | Scheiber . | |
| 3,969,588 | 7/1976 | Raydon et al. . | |
| 4,230,905 | 10/1980 | Crum et al. | 381/24 |
| 4,308,424 | 12/1981 | Bice, Jr. | 381/17 |
| 4,403,112 | 9/1983 | Modafferi | 381/24 |
| 4,953,213 | 8/1990 | Tasaki et al. . | |
| 4,955,057 | 9/1990 | Tominari | 381/63 |
| 5,027,687 | 7/1991 | Iwamatsu . | |
| 5,073,945 | 12/1991 | Kageyama et al. . | |
| 5,121,433 | 6/1992 | Kendall et al. | 381/17 |
| 5,136,650 | 8/1992 | Griesinger . | |

FOREIGN PATENT DOCUMENTS

| | | | |
|---|---|---|---|
| 2-106741 | 8/1990 | China . | |
| 2224246 | 11/1973 | Fed. Rep. of Germany | 381/89 |
| 3-265400 | 11/1991 | Japan | 381/18 |

OTHER PUBLICATIONS

Chamberlin, Musical Applications of Microprocessors, 1980, pp. 447–451.

*Primary Examiner*—Forester W. Isen

*Attorney, Agent, or Firm*—David L. McCombs

[57] ABSTRACT

A system for the multichannel reproduction of sound in which a plurality of loudspeakers connectable to a surround sound processor is disclosed. Circuits for adapting the processor to provide left and right side output signals are also disclosed. Left and right side dual loudspeakers are disclosed wherein each dual loudspeaker contains two independent drivers, one facing the front and the other the rear of the listening area, the front-facing drivers being connectable to the left and right side output signals and the rear-facing drivers being connectable to the corresponding left and right rear output signals of the processor. The dual loudspeakers operate in a first mode to produce a dipole sound radiation pattern whenever the signals are applied in antiphase to the front-facing and rear-facing drivers thereof, thereby producing a diffuse sound field, and operate in a second mode to produce a hemispherical, omnidirectional sound pattern when the signals are applied to the respective drivers in phase, thereby producing a focused sound field with good localization characteristics. An operation mode-switching circuit implements the desired mode selectable by the user.

7 Claims, 5 Drawing Sheets

SURROUND SOUND LOUDSPEAKERS

This is a divisional of co-pending application Ser. No. 07/789,530 filed on Nov. 14, 1991 now U.S. Pat. No. 5,199,075.

TECHNICAL FIELD

The present invention relates in general to the periphonic reproduction of sound using multiple loudspeakers spatially positioned around a listening area. More specifically, the invention relates to systems for developing suitable loudspeaker feed signals and loudspeakers for deployment in a room for such multichannel audio reproduction purposes.

BACKGROUND OF THE INVENTION

Surround sound processing, in general, is a technique wherein a stereophonic pair of signals from a source such as prerecorded audio or live transmissions of audio signals, with or without video, is processed to yield a set of signals for the purpose of feeding several loudspeakers placed around the listening area, so as to give an impression of spatially surrounding the listener with the sounds, particularly any ambience, and/or broadening the sound field to wrap around the listener.

Typically, the signals are generated by surround sound processors, which may be of many types, and the source signals may either incorporate positional encoding by means of specific phase differences and amplitude ratios, or may be unencoded. Surround sound processors may be divided into two main classes, fixed matrix or passive, and variable matrix or active types.

In the former, the various loudspeaker feed signals are derived by judicious mixing or matrixing of the pair of stereophonic signals in different proportions and different relative phases, with zaatrixing coefficients which remain fixed in time, and have no relationship to the instantaneous signal information content.

In the latter, in addition to generating a fixed matrix for each loudspeaker feed, a number of control signals are derived from the input signal pair according to the relative amplitudes and phases of these signals, and a number of cancellation signals are generated by means of variable gain elements whose gains are controlled by the various control signals, the cancellation signals being applied to the loudspeaker feed matrix so as to reduce crosstalk between the loudspeaker feed signals and increase separation of the predominant sound in the direction in which it is desired to be heard. Thus the signals are processed with a variable matrix, which is responsive to the signal information content.

Surround processors of the variable matrix type described have been the subject of several inventions by Fosgate, specifically including those described in U.S. Pat. No. 4,932,059 and copending U.S. patent application Ser. No. 533,091 entitled "Surround Processor".

The proper placement and types of loudspeakers for such surround sound processors have not usually been well defined, although in general the array of loudspeakers is assumed to be placed in specific positions relative to the listener—usually at least four loudspeakers are placed in a square or rectangular array, one at each corner, with the listener at or near the center of the array, and additional speakers may be placed in the central positions of the front, rear or sides of the rectangle. Other speakers for special purposes, such as subwoofers for deep bass, may also be positioned to surround the listener in some such way, if desired.

Some newer surround sound systems, such as that known as "Ambisonics" due to Gerzon, have attempted to control the sound field by such means as a "layout" control which is adjusted to suit the approximate size and shape of the rectangular array of four loudspeakers or various other possible arrangements, e.g. of six loudspeakers. The Lucasfilm, Ltd. THX system also specifies an array of loudspeakers having certain characteristics and placed in a certain arrangement in the listening room. Reference is made to the specification for the THX Home Theater Surround prepared by Lucasfilm, Ltd., for example.

In the latter system, intended for the reproduction of surround-encoded movie sound tracks, the proprietors intend that the surround sound effects be diffused in the rear of the room, this being achieved by several methods in combination, including the provision of rear loudspeakers having dipole radiation characteristics such that the rearward radiation lobe thereof is out of phase with the frontward radiation lobe in the midrange and upper frequencies. However, for widely spread surround sound presentation of music from a stereophonic source, for example, it is desirable that the sound field around the sides and rear of the room remain focused and in phase, so that imaging of sounds is good all around the room.

Accordingly, there is a need for the development of surround sound systems capable of generating a set of signals for application to an array such as to meet the general THX specifications, as well as being switchable to other modes for presentation of musical or other stereophonic or monophonic program material as desired by the listener, so as to give either a more focused or a more diffused spatial sound field. There is further a need for the provision of appropriate types of loudspeaker arrangements for use in conjunction with such surround processor systems.

SUMMARY OF THE INVENTION

It is an object of the invention to provide an appropriate array of loudspeakers for the presentation of sound in a listening area so as to surround the listener with a sound field which may either be focused or diffused, according to the listener's preference and to the mode of operation of an associated surround sound processor.

It is a further object of the invention to provide a surround sound processor for use with such an array of loudspeakers, which may be switched to provide either focused or diffuse sound fields, and may specifically include a mode suitable for THX Home Theater surround sound reproduction of the sound tracks of certain Dolby Surround encoded prerecorded movies.

It is a further object of the invention to provide a specific loudspeaker design suitable for inclusion in such a loudspeaker array and having the polar characteristics required to produce a diffuse sound field when utilized with a surround sound processor according to this invention.

In this context, a focused sound field provides precise imaging for sounds localized along the sides or rear of the listening area, while a diffused sound field spreads these sounds to occupy the whole surrounding space without being localized.

In accordance with these and other objects, a system for the multichannel reproduction of sound is provided in which a plurality of loudspeakers, driven by signals from a surround sound processor, surround a listening area. In a departure from the art, the present invention provides for a pair of dual loudspeakers at the left and right sides of the listening area, each containing independent drivers, one facing the front and the other the rear of the listening area, and a mode switching circuit for the surround sound processor adapted to apply the signals to each of these drivers in each dual loudspeaker in appropriate ways for generating either focused or diffused sound field patterns.

The dual loudspeakers operate in a first mode to produce an omnidirectional, hemispherical pattern when the signals applied to their elements are in phase, wherein good imaging around the sides and rear of the listening area is produced, and in a second mode to produce a diffused sound field when the signals applied to their elements are in antiphase, wherein the side and rear sounds are not localized. With the mode switching circuit for the surround sound processor, various modes of operation of the system offer desirable sound reproduction characteristics for reproduction of sound from different audio sources and of different kinds, such as rock, jazz or classical music, or movies recorded in different formats, for example.

In an illustrative embodiment, the present invention embodies the specific arrangement of the above-described loudspeakers located relative to a listening area. Further, a unique mode-switching circuit is provided whereby a surround sound processor of the type generally used may be switched to generate suitable signals for application to drive the dual loudspeakers, after power amplification, in accordance with these various desired modes of operation. This mode-switching circuit adapts the surround sound processor to provide left and right side output signals derived from the left and right front and left and right back outputs thereof, for driving the left and right side elements of the dual loudspeakers either in phase or in antiphase with the signals applied to the left and right rear elements of the dual loudspeakers.

In another aspect, a third dual loudspeaker element having two independent drivers is located in the rear of the listening area, for the purpose of bringing the rear portion of the sound field more into the back of the listening area. This third loudspeaker is positioned so that the first driver faces to the left rear of the listening area, and the second driver faces to the right rear of the listening area, each driver receiving the corresponding one of the left rear and right rear signals provided by the surround sound processor.

In another aspect, a ceiling-mounted array of directional loudspeaker elements is placed above the listening area, for the purpose of providing the sound to the sides and rear of the listening area by reflection off the room walls, and is adapted to provide the same ability to produce a focused or a diffused sound field as described for the dual loudspeakers above.

In another aspect, operation of the dual loudspeakers at the sides of the listening area or of the drivers at the front and rear of the ceiling mounted array in the second mode described above causes the drivers to be driven in phase at low frequencies but in antiphase at midrange and high frequencies, resulting in a dipole radiation pattern at midrange and high frequencies and an omnidirectional pattern at low frequencies, with no loss of bass output.

Thus in a first mode of operation of the switching network, the side and rear speaker drivers of the dual loudspeakers are driven in phase with the front loudspeakers to provide an omnidirectional polar pattern with good imaging at the sides and rear; in a second mode of operation, the side and rear speakers are driven in antiphase at midrange and high frequencies but in phase at low frequencies, and at a lower level, to provide a diffused sound field; and in a third mode of operation, the side and rear drivers are driven in antiphase at midrange and high frequencies and in phase at low frequencies, at equal levels, to provide a dipole radiation pattern suitable for a specific format of presentation for movie sound tracks, without sacrificing bass response.

BRIEF DESCRIPTION OF THE DRAWINGS

The novel features believed characteristic of the present invention are set forth in the appended claims. The invention itself, as well as other features and advantages thereof, will best be understood by reference to the following detailed description of an illustrative embodiment when read in conjunction with the accompanying FIGURES, wherein:

FIG. I is a plan view of an arrangement of loudspeakers in a listening room, suitable for the reproduction of sound employing a multichannel surround sound processor having seven output channels.

DETAILED DESCRIPTION OF THE INVENTION

It will be appreciated that the present invention can take many forms and embodiments. Some embodiments of the invention are illustrated herein for purposes of understanding the invention. The embodiments shown herein are intended to illustrate, and not to limit the invention. In the accompanying drawings, part numbers and values of components are set forth, which components and parts are commercially available at the present time from commercial vendors.

Figure 1:
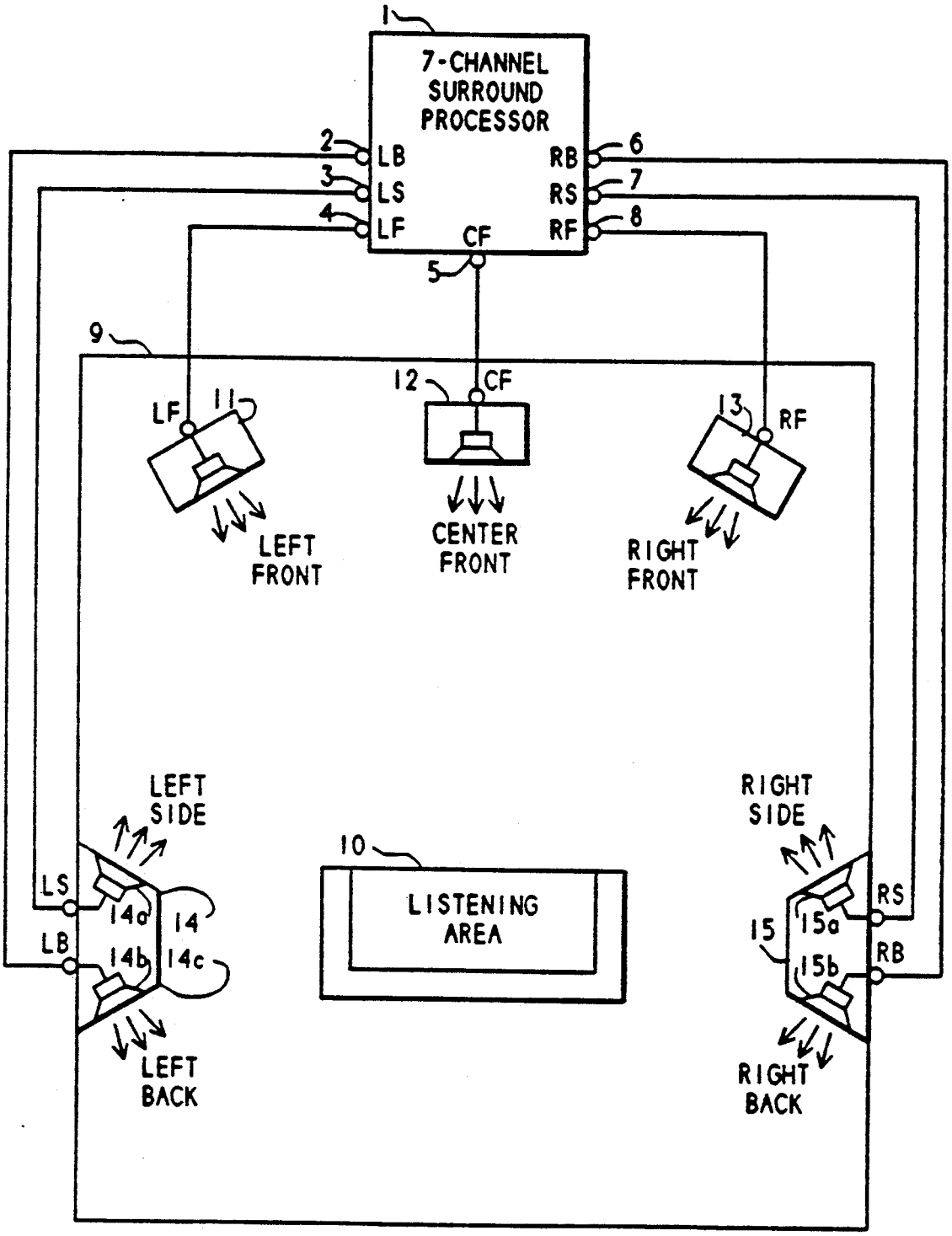

Referring to FIG. 1, a surround sound processor 1 typically having seven output connectors 2 through 8, is connected to several loudspeakers in a listening room 9, deployed around a listening area 10 therein.

Specifically, these loudspeakers comprise three conventional loudspeakers 11, 12, and 13, placed respectively at positions left front, center front and right front, near the front wall of, the listening room, and being connected respectively to output signals LF, CF and RF from terminals 4, 5 and 8 of the surround sound processor 1; and two additional loudspeakers 14 and 15 of an unconventional type, according to this invention.

Loudspeakers 14 and 15 are designed to be placed close to the side walls of the room 9, and each employ two loudspeaker driver elements 14*a*, 14*b* and 15*a*, 15*b*, respectively, arranged to point in directions toward the front and the rear of the room. The signals feeding these loudspeakers 14, 15 are such as to provide either omnidirectional or bidirectional dipole response patterns. In loudspeaker 14, which is placed on the left side wall of the room, the front-facing element 14*a* receives a signal designated LS from output terminal 3 of surround sound processor 1. The rear-facing element 14*b* receives a signal designated LB from output terminal 2 of surround sound processor 1. Similarly, loudspeaker 15 on the right side wall receives a signal RS from terminal 7 of processor 1 to drive its front-facing element 15*a*, and a signal RB from terminal 6 of processor 1 to drive its rear-facing element 15*b*.

When the front and rear-facing elements 14*a*, 14*b* and 15*a*, 15*b* are driven essentially in phase, the response pattern of these loudspeakers 14 and 15 is effectively omnidirectional in a hemisphere facing into the room. The actual pattern may be controlled by changing the ratio of front and rear drive signal amplitudes. When the front and rear-facing elements 14*a*, 14*b* and 15*a*, 15*b* are driven in antiphase, however, a dipole pattern emerges, the front-facing elements 14*a*, 15*a* being in antiphase with the front loudspeaker on the same side 11, 13, respectively, and the rear-facing elements 14*b*, 15*b* being in phase therewith. This provides a more diffuse and unfocused sound field in the rear of the room 9.

The loudspeakers 14 and 15 are each mounted in a box shaped similarly to that shown in the diagram of FIG. 1, and designated as 14*c*. While not shown, the box 14*c* may be divided into two separate enclosures by an internal divider, either horizontally, vertically or diagonally. If the internal divider is horizontal, one loudspeaker element 14*a* will be above the other element 14*b*. Although this has little effect on the diffuse sound field provided when the two loudspeakers are fed with equal antiphase signals, it may be preferable that the left and right elements 14*a*, 14*b*, 15*a*, 15*b* be constructed as mirror images, so that the upper element 14*a*, 15*a* faces forwards and the lower element 14*b*, 15*b* backwards, in both cases. Alternatively, the box 14*c* may be constructed with a sloping partition, so that both elements 14*a*, 14*b* are on the same level. The exact dimensions and volume of the box 14*c* are dependent on the size of the driver elements and these and other parameters are well known to those skilled in the art of loudspeaker design and manufacturing. The loudspeaker cabinet may also be designed for mounting on, or partially in, a wall of the listening area. Therefore, no detailed drawing of a preferred loudspeaker box 14*c* is shown.

Figure 2:
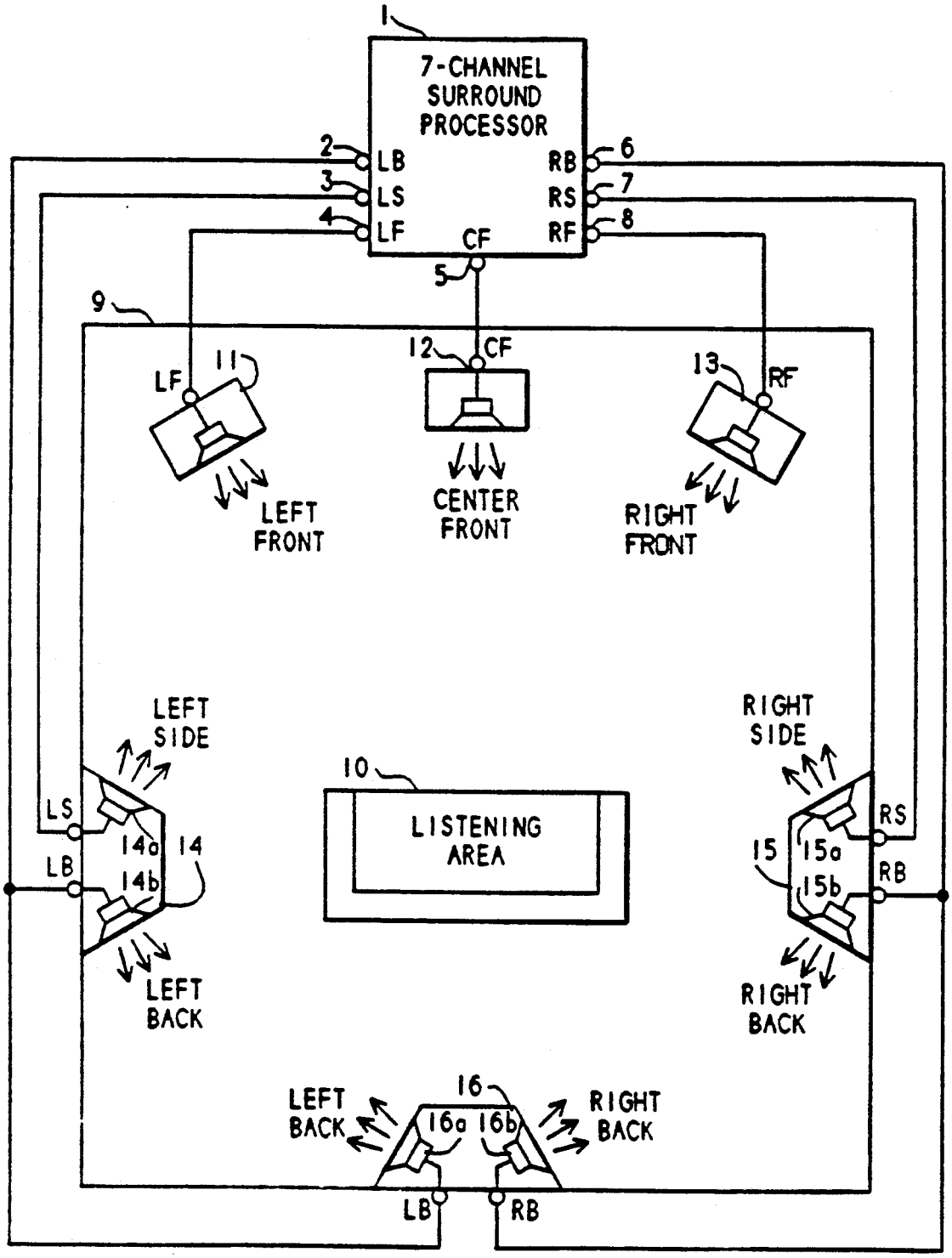
FIG. 2 is a plan view of another loudspeaker arrangement similar to that of FIG. 1, but with the addition of a rear loudspeaker element.

FIG. 2 shows a modification of the scheme in FIG. 1, wherein a third loudspeaker 16 is provided having driver elements 16*a* and 16*b* facing in different directions. The loudspeaker 16 is placed on the rear wall of the room 9, and elements 16*a* and 16*b* receive the LB and RB signals from terminals 2 and 6 respectively of processor 1. This is intended to bring the left back and right back components of the sound field more behind the listener than can be achieved with the arrangement of FIG. 1.

Figure 3:
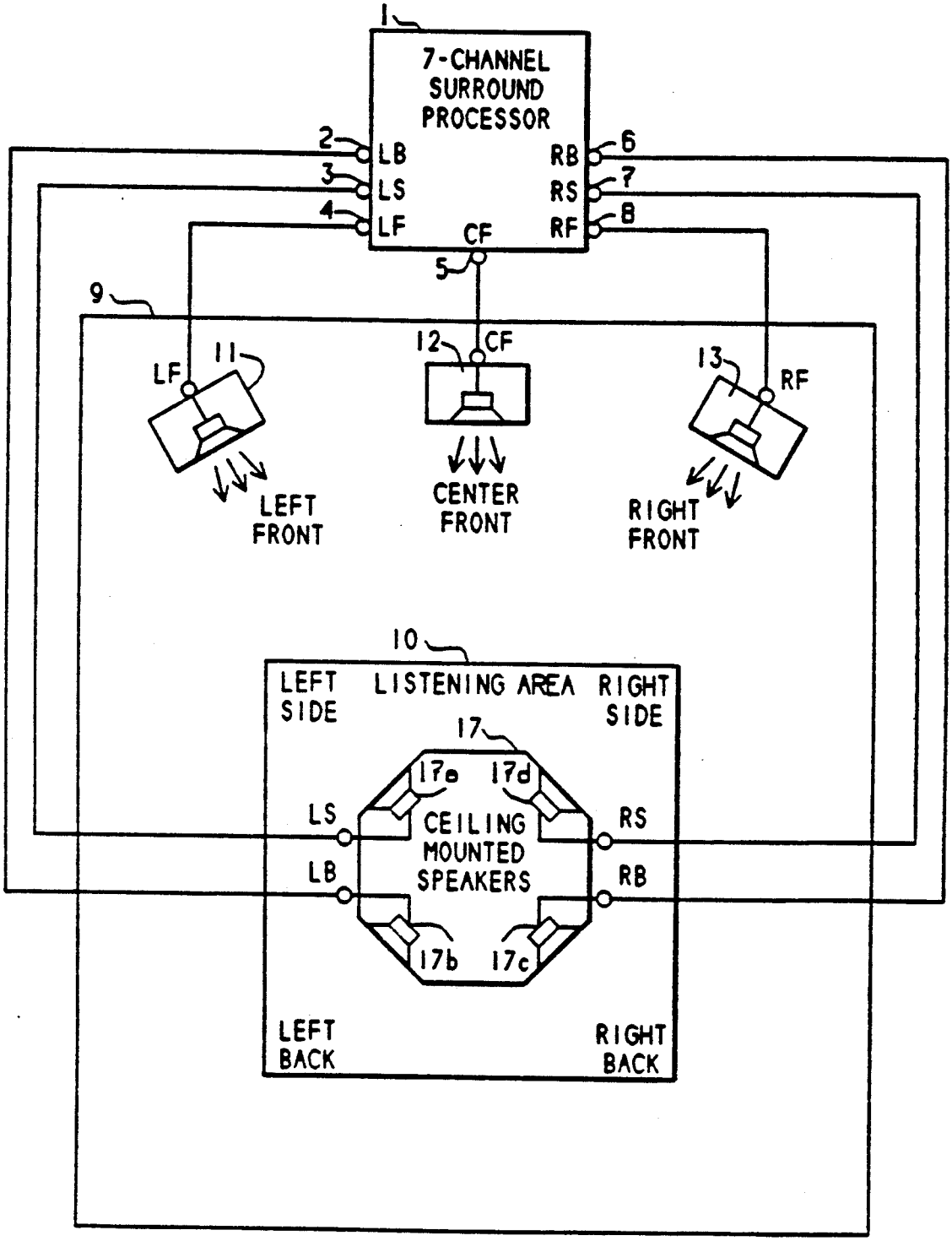
FIG. 3 is a plan view of yet another arrangement of loudspeakers including a ceiling-mounted array, but otherwise similar to that of FIG. 1.

FIG. 3 shows an array 17 of side and back loudspeakers mounted above the listening area, so as to reduce the problems of providing for five or six loudspeaker cabinets on the floor or walls of the room.

In the array 17, four loudspeaker driver elements 17*a*–17*d* are provided, these being driven by signals LS, LB, RB and RS from terminals 3, 2, 6, and 7 of processor 1, respectively. The elements 17*a*–17*d* are so arranged that the LB signal drives the element 17*b* facing towards the left rear of the room and the RB signal drives the element 17*c* facing towards the right rear of the room. The LS signal drives the element 17*a* facing forward on the left side, and the RS signal drives the right forward facing loudspeaker element 17*d*. The elements 17*a*–17*d* fire into the walls of the room 9 to provide the side-wall and rear images primarily by reflection; they also incorporate the dipole sound field when fed with antiphase signals as described for loudspeakers 14 and 15.

While there are no significant problems in localization with the arrangements of FIGS. 1 and 2 in larger rooms, in smaller rooms where the side and rear loudspeakers would be much closer to the listening area than the front loudspeakers, Haas precedence effects may upset localization if delays are not used in the side and rear channels.

The arrangement of FIG. 3 may perform well in such smaller, fairly reflective rooms, provided that the elements are quite directional, as it yields a much longer path length from speakers to listener, so that the arrival times from the rear and side channels match those from the front more closely, minimizing Haas precedence effect errors in localization. A very large apparent sound field can be produced by this method.

Figure 4:
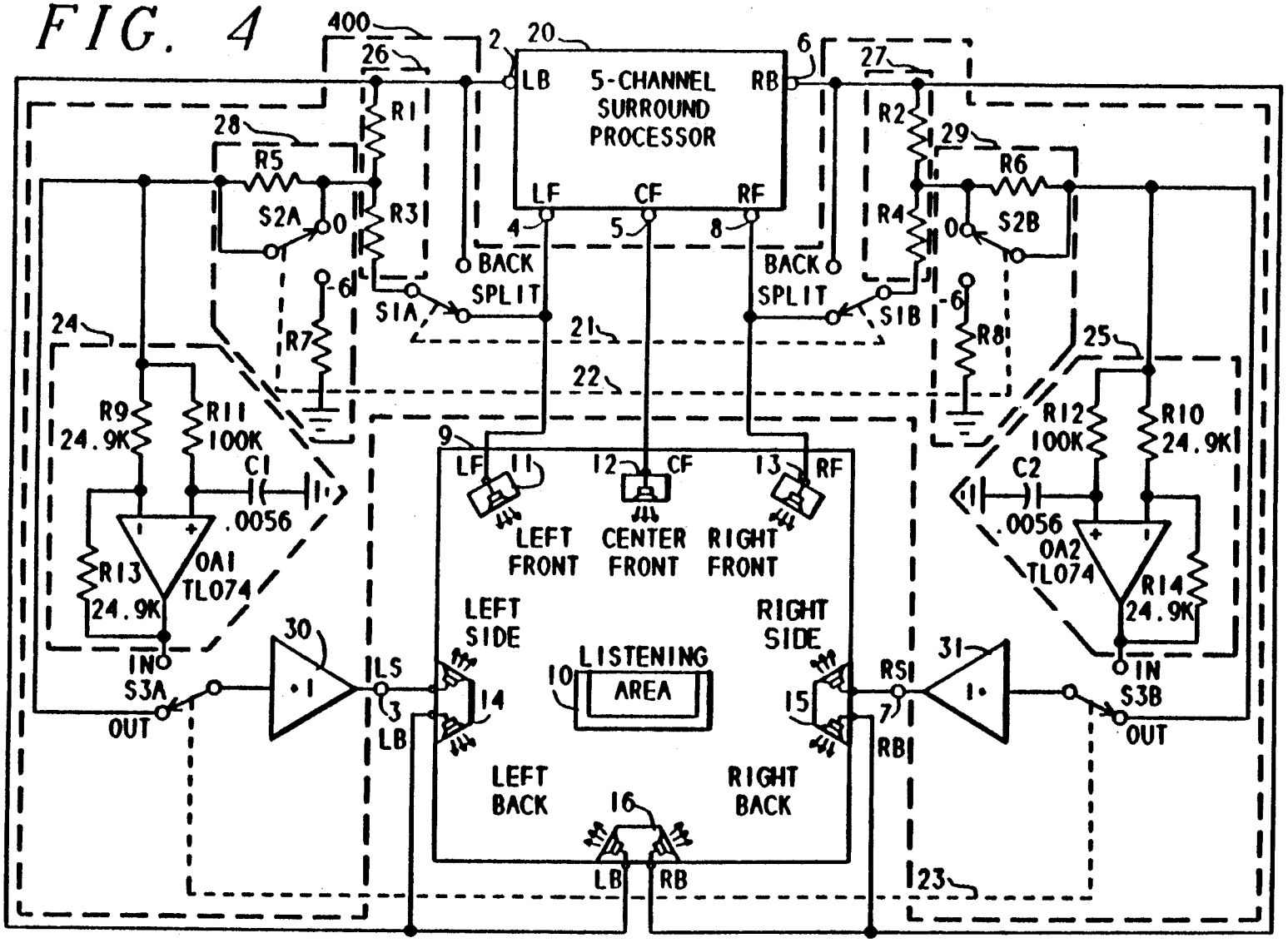
FIG. 4 is a schematic diagram of a switchable network for deriving suitable loudspeaker feed signals for the arrangements of FIGS. 13, from a surround sound processor having five actively derived output channels.

Referring now to FIG. 4, a basic surround sound processor 20 provides an active matrix with five output channels designated LB, LF, CF, RB and RF, each presumed to be at line level and low impedance. These are connected to terminals 2, 4, 5, 6, and 8 respectively, to correspond with the same terminals of the processor 1 of FIGS. 1–3. According to the invention, a driver mode-switching circuit 400 is shown either side of processor 20 which provides various ways of deriving the LS and RS signals for driving (via power amplification and gain control elements not shown) the loudspeaker arrays of FIGS. 1–3, that of FIG. 2 being shown for reference.

The switching circuit of FIG. 4 comprises three switches 21, 22 and 23 and two phase shifters 24 and 25. The switches 21–23 are each dual-ganged units providing corresponding switching in the left side channels LB, LF and the right side channels RB, RF.

Switch 21 comprises a pair of switches S1A and S1B each of which is operable between a "split" position and a "back" position. In the split position as shown, the switch S1A applies the LF signal to one end of a potential divider 26 comprising resistors R3 and R1, the other end of the divider 26 being connected to the LB signal. The resulting signal is a weighted average of the LF and LB signals. The switch S1B in the split position similarly applies the RF signal to one end of a potential divider 27 comprising resistors R4 and R2, the other end of the divider 27 being connected to the RB signal. The resulting signal is a weighted average of the RF and RB signals. Typically, the resistors R1 and R3 are equal, providing a signal which is the electrical center or average between the front and back signals. Resistors R2 and R4 match resistors R1 and R3 respectively.

In the alternate "back" position of switch 21, the switch S1A applies the LB signal to both ends of the left potential divider 26 and the switch S1B applies the RB signal to both ends of the right potential divider 27. This preserves the same output impedance at the junction of resistors R1 and R3 in the divider 26, and at the junction of resistors R2 and R4 in the divider 27.

A switchable potential divider 28 receives the signal passing from the junction of resistors R1 and R3 in the divider 26. Similarly, a switchable divider 29 receives the signal passing from the junction of resistors R2 and R4 in the divider 27. The switch 22 comprises switch elements S2A and S2B, switchable between a zero ("0") position and a "−6" position. When the elements S2A, S2B are in the "−6" position, the respective dividers 28, 29 provide an attenuation of 6 dB. When the elements are in the "0" position, the respective dividers bypass this attenuation. The values of resistors R5 and R7 in the divider 28 are chosen so that the impedance will be the same in either position of switch 22 but the signal will be reduced by 6 dB when the element S2A is in the 11-611 position. Resistors R6 and R8 in the divider 29 are equal, respectively, to resistors R5 and R7. For example, if the resistors R1 and R3 in the divider 26 are each 4.99K, the output impedance from the junction therebetween will be 2.5K with the switch 22 in the "0" position. To attain a 6dB loss, the resistors R5 and R7 of the divider 28 would be 2.49K and 4.99K, respectively, yielding the same output impedance of 2.5K. The loading of the following filter, discussed below, is neglected in this calculation.

The signals from switch 22 pass into all-pass phase shifters 24 and 25. The phase-shifter 24 comprises an operational amplifier OAI, which may be of industry type TL074, for instance, connected as an inverter with equal input and feedback resistors R9 and R13, but with the non-inverting input connected to the junction of resistor R11 and capacitor C1, which network connects between the input and ground of the shifter 24. This is a conventional single pole all-pass network, having a constant gain magnitude over the audio frequency range, but with a phase shift that varies with frequency from zero at low frequencies to 180 degrees at high frequencies. The phase shifter 25 is identical to phase shifter 24, all corresponding resistor and capacitor values being the same, and preferably being matched to one percent accuracy.

The outputs of the phase shifters 24, 25 are connected to the third switch 23. The switch 23 includes switch elements S3A and S3B, each switchable between an "in" position and an "out" position. The output of the shifter 24 is connected to the switch element S3A in order to provide signals for the left side (LS) channel network to the loudspeaker 14. The output of the shifter 25 is connected to the switch element S3B in order to provide signals for the right side (RS) channel network to the loudspeaker 15. The outputs of phase shifters 24, 25 are connected respectively via the switch elements S3A and S3B to line amplifiers 30 and 31. The outputs of line amplifiers 30, 31, respectively, are the LS and RS outputs of the surround sound processor, and are applied via terminals 3 and 7 respectively to the appropriate loudspeaker drivers **14*a*, 15*a*, or 17*a*, 17*d* for receiving LS and RS signals as shown in FIGS. 1-3. When the switch elements S3A and S3B are in the "in" position, the phase shifters 24, 25 are connected to the respective line amplifiers 30, 31 and provide phase shifted outputs on the LS and RS channels, relative to the outputs in the LB, RB channels. When the switch elements S3A and S3B are in the "out" position, line amplifiers 30, 31 receive inputs from the dividers 28, 29 instead of from the phase shifters 24, 25, so that the outputs on the LS, RS channels are in phase with those on the LB, RB channels respectively. Thus in the "in" position of the switch 23, the phase shifters 24, 25 are effective and provide antiphase signals to the LS, LB and RS, RB channels at high frequencies, creating the dipole radiation pattern desired, and diffusing the sound field, while in the "out" position of switch 23**, the signals provided to the the LS, LB and RS, RB channels are in phase and therefore create the omnidirectional response with good imaging properties as desired for a focused sound field.

Thus the elements of circuit 400 described above, together with the surround sound processor 20, effectively combine to make the 7-channel surround sound processor 1 of FIGS. 1-3, although alternative techniques are also possible.

In operation, several modes are available for providing audio signals on the LS and RS channels to the loudspeakers 14, 15, or 17 depending upon the positions of the switches 21-23 in the driver circuit described above. Since the modes are identical for the LS and RS channels, only the LS channel will be ref erred to in the following discussion of the available modes.

In the first mode, the switch 21 is in the "split" position, the switch 22 is in the 11611 position, and the switch 23 is in the "out" position. Therefore, the signal delivered to the LS output terminal 3 consists of the average of the LF and LB signals at terminals 2 and 4 respectively of processor 1, attenuated by 6 dB, and applied in phase with the LF and LB signals at terminals 2 and 4. This results in a left side signal which is electrically centered between the left front and left back signals being applied to the left side speaker element **14*a*, and the polar response of the combination signal of speakers 14*a* and 14*b* of speaker 14** is nominally omnidirectional, generally directed more to the rear, with the side signal LS providing a "fill" between the front and back sounds and improving side imaging thereby.

In a second mode, the switch 21 is in the "back" position, the switch 22 is in the "−6" position and the switch 23 is in the "in" position. In this mode, therefore, the left side signal is derived only from the LB signal, and is at a level of −6 dB relative thereto, and it is applied via the phase shifter 24 to the LS terminal. At midrange and high frequencies, therefore, this signal is out of phase with the signal in the LB channel, thereby resulting in a more diffuse sound field at the sides of the room. Typically, in this mode, the back signals LB, RB from processor 1 are also delayed so that the sound is not correlated with that at the front of the room.

In a third mode, the switches 21 and 23 are as stated above for the second mode, but the attenuator switch 22 is in the "0" position, causing the signals applied to the rear and side driver elements of loudspeakers 14, 15, to be at equal levels and thereby producing the dipole radiation pattern required for the THX system. This mode is used with the other elements of the THX circuits in processor 1 to provide the dipole loudspeaker response required, along with the delay, decorrelation and frequency response shaping provided for in the THX specifications for the rear channels.

In the modes where the phase shifters are used, it is important to note that the bass frequencies from both speakers are in phase, the phase inversion being effective at higher frequencies. In the standard THX system, one element of a dipole pair is rolled of f by a capacitor, so that it produces no bass output, as otherwise the bass would cancel out, but there is still a 3 dB loss in bass; the present invention permits both elements to provide bass output in phase, thereby reducing the need for more powerful amplifiers, subwoofers, or bass equalizers.

The other reason for using a phase-shifter rather than simply driving the two elements in antiphase is that many people are very sensitive to out-of-phase bass signals in separated speakers, which yields an unpleasant feeling of pressure in the head.

The modes just described for the surround sound processor 1 are summarized in the following Table I with suggested audio input sources for each mode:

TABLE I

| Audio Source | Switch 21 (split/back) | Switch 22 (0/−6) | Switch 23 (In/Out) | Reference Code |
|---|---|---|---|---|
| Rock | split | −6 | out | S6O |
| Popular | back | −6 | in | B6I |
| Jazz | back | −6 | in | B6I |
| Dolby Pro-Logic | back | −6 | in | B6I |
| Pro-Logic THX | back | 0 | in | B0I |
| Movie 70 mm | back | −6 | in | B6I |
| Movie 35 mm | back | −6 | in | B6I |
| Chamber | split | −6 | out | S6O |
| Orchestra | back | −6 | in | B6I |
| Monophonic Enhance | split | −6 | out | S6O |

The three modes described above are given a reference code designation of S60, B6I and B0I, respectively. The mode reference codes are shorthand codes for the positions of the three switches 21–23. Thus, the first letter refers to switch 21, in either "back" (B) or "split" (S) position, the second to switch 22, in either "0 dB" (0) or "−6 dB" (6) position, and the third to switch 23 in either "in" (I) or "out" (O) position.

Although the above three modes have proven to be the most useful, alternative modes are also envisaged. For example, five other modes are available with the switch positions corresponding to the reference code designations S0O, S0I, S6I, B60 and B0O. These alternative modes may have beneficial qualities in other surround sound processing functions.

Figure 5:
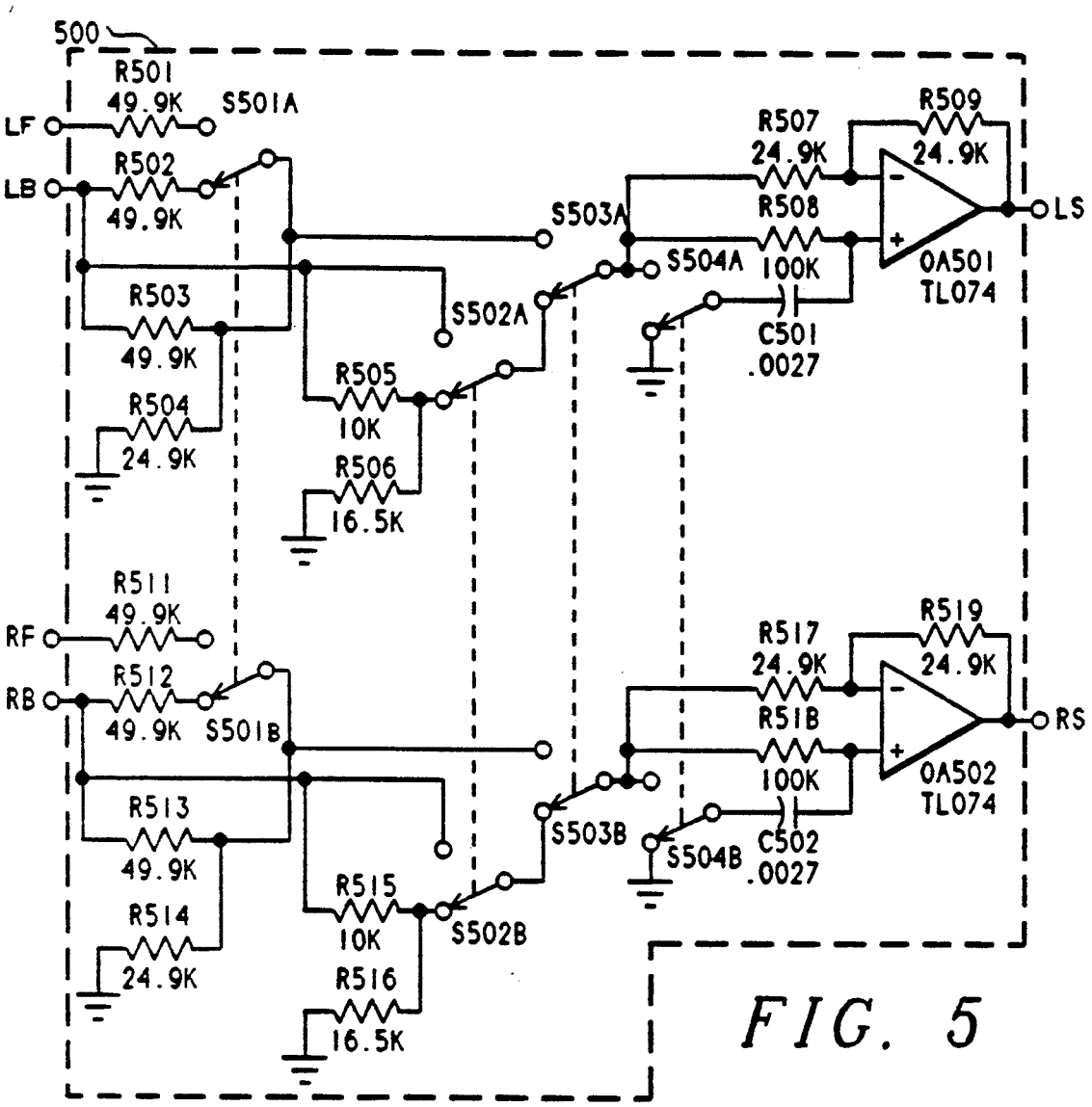
FIG. 5 is a detailed schematic diagram of an alternative switchable network according to the invention.

Referring now to FIG. 5, in which an alternate switching network 500 is depicted, terminals 4 and 2 of the surround sound processor 20 (not shown) connect the LF and LB signals, respectively, via resistors R501 and R502, respectively, to switch S501A, the pole of which is connected to resistor R503 which returns to the LB signal and resistor R504 to ground. With the values given, resistors R501–R503 all being 49.9K and resistor R504 being 24.9K, when switch S501A is in the "split" position, resistors R501 and R503 split the LF and LB signals and resistor R504 causes an attenuation of 6 dB at the junction of all three resistors. When switch S501A is in the "back" position, resistors R502 and R503 are in parallel, and with resistor R504 form a 6dB attenuator. Thus this switch S501A can provide either LB or the split signal, with an attenuation of 6dB and an output impedance of 12.5K.

Switch S502A receives either the LB signal direct or via an attenuator comprising resistors R505, 10K and R506, 16.5K. Switch S503A connects either the output of switch S501A or that of switch S502A to an all-pass network.

The all-pass network comprises op-amp OA501, with resistor R507 as the inverting input resistor, resistor R508 as the non-inverting input resistor, resistor R509 as the feedback resistor, and capacitor C501 as the phase shifting capacitor. Switch S504A either grounds the bottom end of capacitor C501 or else connects it to the input signal.

Switch S501A corresponds functionally with switch S1A of FIG. 4, except that a 6 dB attenuation is always present when the output of this switch is selected by switch S503A. Switch S502A corresponds with switch S2A of FIG. 4, but is only effective when selected by switch S503A. Switch S504A roughly corresponds with switch S3A of FIG. 4, as it switches the all-pass characteristic of the filter in or out. However, there is no need for a separate buffer, as the output of op-amp OA501 is a low impedance point and can drive terminal 3 directly, to provide the LS signal.

An exactly similar arrangement is provided in the lower half of FIG. 5 for receiving the right front and right back outputs of the surround sound processor 20 (not shown) and generating a right side output.

In Table I above, it will be noted that only the three modes referred to as S60, B6I and BOI are used. The corresponding settings of the switches in FIG. 5 are:

TABLE II

| Mode | S501 | S502 | S503 | S504 |
|---|---|---|---|---|
| S6O | up (split) | any | up (S501) | up (out) |
| B6I | any | down (6dB) | down (S502) | down (in) |
| B0I | any | up (OdB) | down (S502) | down (in) |

In these instances, S501 appears redundant, but is present to prevent a split mode being selected when the center front channel is rendered inoperative for installations where no center front loudspeaker 12 is provided. In this case, the mode B60 is automatically selected instead of the mode S60. In the S60 mode, amplifier OA501 behaves as a unity gain buffer, so that the 12.5K source impedance from resistors R501, R503 and R504 is of no consequence. In the BOI mode, the LB signal is applied directly via S502A and S503A to the filter, and S504A is down, so that OA501 acts as an all-pass network.

In the B6I position, the attenuator formed by R505 and R506 is in circuit, and has an output impedance of about 6.25K, which is sufficiently high that the all-pass filter will load it significantly at higher frequencies, but at low frequencies the input impedance of the all-pass filter increases. This results in a shelving characteristic in the frequency response, which has been found desirable in the specific modes where this occurs, as indicated is Table I above. The attenuation in 6.55 dB at high frequencies and 4.22 dB at low frequencies, providing about 2.33 dB of shelving. A different shelving characteristic can be obtained when the all-pass filter is driven from the output of S501A; this will have 6 dB loss at low frequencies and 10.2 dB loss at high frequencies, providing 4.2 dB of shelving.

It may be noted that, in addition to the provision of dipole loudspeakers in the sides of the room, THX Home Theater mode also requires frequency shaping filters and decorrelation of the rear signals, by methods not discussed here. It is presumed that in the THX mode, these required elements will also be included in the side and rear channel processing as required, although not shown in FIGS. 1–3. Other modifications of similar nature, such as the inclusion of different frequency shaping filters and/or delays, may be added in other processor modes.

These and many other modifications will become apparent to those experienced in the art, without departing from the spirit of the present invention.

What is claimed is:

1. A loudspeaker combination for arrangement in a listening area and for reproducing sound from an audio signal source, said loudspeaker combination comprising:

a first directional loudspeaker driver aimed generally towards the front of the listening area;

a second, independent directional loudspeaker driver aimed generally towards the rear of the listening area;

first and second loudspeaker enclosures for loading said first and second loudspeaker drivers;

a phase shifter circuit for connection between said audio signal source and said first loudspeaker driver, having an all-pass frequency response for providing a phase shift which varies from nearly zero at low frequencies to nearly 180 degrees at higher frequencies; and said second loudspeaker driver being driven with a signal at an equal level to that of said first loudspeaker driver, said signal derived directly from said audio signal source;

such that said first and second loudspeaker drivers are driven in phase at low frequencies and out of phase at high frequencies, resulting in a dipole polar pattern at high frequencies and an omnidirectional pattern at low frequencies, with no loss of bass output.

2. The apparatus of claim 1 wherein said first and second loudspeaker enclosures are contiguously connected together having the appearance of a single cabinet.

3. The apparatus of claim 1 wherein said phase shifter circuit further comprises a switch operative to remove the phase shift at all frequencies so as to drive both loudspeakers in phase at all frequencies thereby providing an omnidirectional pattern instead of a dipole pattern at high frequencies.

4. The apparatus of claim 1 wherein said loudspeaker combination is adapted for mounting on the side or rear wall of a listening area.

5. The apparatus of claim 1 wherein said loudspeaker combination is adapted for mounting partially in the side or rear wall of a listening area.

6. The apparatus of claim 1 wherein said loudspeaker combination is adapted for mounting above a listening area and for causing sounds therefrom to enter the listening area primarily by reflection from the walls thereof.

7. The apparatus of claim 2 wherein a plurality of said loudspeaker combinations are connected contiguously to provide a single unit adapted for mounting above a listening area.

* * * * *

UNITED STATES PATENT AND TRADEMARK OFFICE

CERTIFICATE OF CORRECTION

PATENT NO. : 5,301,237

DATED : April 5, 1994

INVENTOR(S) : James W. Fosgate

It is certified that error appears in the above-indentified patent and that said Letters Patent is hereby corrected as shown below:

Col. 1, line 38, "zaatrixing" should be --matrixing--.

Col. 4, line 35, "FIGS. 13," should be --FIGS. 1-3,--.

Col. 7, line 12, "11-611" should be -- "-6" --.

Col. 8, line 16, "will be ref erred" should be --will be referred--.

Col. 8, line 19, "11611" should be -- "6" --.

Col. 8, line 60, "rolled of f by" should be --rolled off by--.

Signed and Sealed this

Sixteenth Day of August, 1994

*Attest:*

Bruce Lehman

BRUCE LEHMAN

*Attesting Officer*

*Commissioner of Patents and Trademarks*